US009850181B1

(12) United States Patent
Patel et al.

(10) Patent No.: US 9,850,181 B1
(45) Date of Patent: Dec. 26, 2017

(54) SINGLE-STEP PRODUCTION METHOD FOR NANO-SIZED ENERGETIC COCRYSTALS BY BEAD MILLING AND PRODUCTS THEREOF

(71) Applicant: The United States of America as Represented by the Secretary of the Army, Washington, DC (US)

(72) Inventors: Rajen Patel, Parsippany, NJ (US); Victor Stepanov, Highland Park, NJ (US); Reddy Damavarapu, Hackettstown, NJ (US); Hongwei Qui, Harrison, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 15/617,147

(22) Filed: Jun. 8, 2017

Related U.S. Application Data

(63) Continuation-in-part of application No. 14/819,730, filed on Aug. 6, 2015.

(51) Int. Cl.

| | |
|---|---|
| ***C06B 45/00*** | (2006.01) |
| ***D03D 23/00*** | (2006.01) |
| ***D03D 43/00*** | (2006.01) |
| ***C06B 25/34*** | (2006.01) |
| ***C06B 21/00*** | (2006.01) |

(52) U.S. Cl.
CPC ..... *C06B 25/34* (2013.01); *C06B 21/0066* (2013.01)

(58) Field of Classification Search
USPC ..... 149/2, 108.8, 109.4, 109.6
See application file for complete search history.

(56) References Cited

U.S. PATENT DOCUMENTS

| | | | |
|---|---|---|---|
| 2012/0305150 | A1 | 12/2012 | Matzger et al. |
| 2014/0205641 | A1 | 7/2014 | Sowa et al. |
| 2015/0080567 | A1 | 3/2015 | Salan et al. |

FOREIGN PATENT DOCUMENTS

| | | |
|---|---|---|
| WO | WO2013143927 | 10/2013 |

OTHER PUBLICATIONS

Hongwei Qiu et al., Nanoscale 2CL-20*HMX high explosive cocrystal synthesized by bead milling, CrystEngComm, Apr. 24, 2015, 17, 4080-83, Royal Society of Chemistry.
Onas Bolton et al., High Power Explosive with Good Sensitivity: A 2:1 Cocrystal of CL-20:HMX, Crystal Growth & Design, Aug. 7, 2012, 12, 4311-14, ACS Publications.
Stephen R. Anderson et al., Preparation of an Energetic-Energetic Cocrystal using Resonant Acoustic Mixing, Propellents, Explos. Pyrotech., 2010, 35, 1-5, Wiley.
Victor Stepanov et al., Production and Sensitivity Evaluation of Nanocrystalline RDX-based Explosive Compositions, Propellants Explos. Pyrotech. May 26, 2011, 36, 240-46, Wiley.
Redner, P. et al., Production and Characterization of RDX, Defense Technical Information Center (DTIC) Report 2006.

*Primary Examiner* — James McDonough
(74) *Attorney, Agent, or Firm* — Lisa H. Wang

(57) ABSTRACT

A single-step method for preparing nano-sized cocrystals of explosive material by preparing a coformer solution having an explosive precursor dissolved into a liquid medium and a second explosive precursor dispersed in the liquid medium. The viscosity and solubility of the coformer solution may be modified by addition of binders, plasticizers, surfactants and anti-foaming agents to the coformer solution. The coformer solution is then milled to mechanically form the cocrystals. Further milling produces the desired cocrystal sizes.

16 Claims, 2 Drawing Sheets

SINGLE-STEP PRODUCTION METHOD FOR NANO-SIZED ENERGETIC COCRYSTALS BY BEAD MILLING AND PRODUCTS THEREOF

RELATED APPLICATIONS

This application is a continuation-in-part application of pending U.S. application Ser. No. 14/819,730 filed Aug. 6, 2015, the contents of which are incorporated herein by reference.

RIGHTS OF THE GOVERNMENT

The inventions described herein may be manufactured and used by or for the United States Government for government purposes without payment of any royalties.

FIELD OF INVENTION

The present disclosure generally relates to methods for synthesizing nano-sized cocrystals of explosive materials in a single step bead milling process. More specifically, the methods disclosed herein provides for cocrystallization of explosives by mechanical activation of explosive co-former precursors using a wet mill process.

BACKGROUND OF THE INVENTION

The invention described herein relates to a single-step production method for nano-sized cocrystals of explosives, and more specifically, a method capable of converting the desired coformer precursors to cocrystals with a mean crystal size in the nanoscale regime.

A compelling need exists to reduce the sensitivity of energetic materials so that accidental detonations from undesired stimuli such as shock and impact are minimized. This is particularly true for more powerful and generally more sensitive high explosives (HEs). One of the strategies for retaining the performance of these explosives while significantly reducing their sensitivity is to combine the energetic species into cocrystals having physical and chemical properties that are distinguishable from the pure species alone. A cocrystal is generated by combining significant quantities (to exclude cases where one material's presence is essentially a defect in the other material) of two or more coformers through chemical or mechanical means into one crystal structure. The hybrid crystals are unique crystal forms of well-known explosive molecules, possessing novel properties in comparison to the crystalline forms of the individual coformers which constitute them.

One practical application for cocrystals is for use in booster explosives, which must have a sufficient energy output to reliably initiate the newer, relatively insensitive main charge explosive fills, while exhibiting an acceptable level of sensitivity to unintended stimuli. Most existing booster high explosive (HE) formulations have unacceptable levels of sensitivity, thereby increasing the vulnerability of the entire munition to accidental initiation. Cocrystals of these HE formulations having reduced sensitivity while retaining the explosive power of their constituent materials would address these limitations.

Energetic materials such as 2, 4, 6, 8, 10, 12-hexanitro-2, 4, 6, 8, 10, 12-hexaazaisowurtzitane (CL-20) and 1, 3, 5, 7,-tetranitro-1, 3, 5, 7-tetrazocine (HMX) are examples of known high explosives having great explosive performance. CL-20, however, has not been widely used because it is more sensitive, i.e. more readily detonates in comparison to other secondary explosives. HMX is a state of the art explosive having one of the highest detonation velocities in the military. Both explosives are insoluble in water but highly soluble in organic solvents.

Cocrystals of CL-20 and HMX were previously synthesized and reported by Bolton et al., "High Power Explosive with Good Sensitivity: A 2:1 Cocrystal of CL-20:HMX" *Cryst. Growth. Des.,* 2012, 12, 4311-4314 and Anderson et al., "Preparation of an Energetic-Energetic Cocrystal using Resonant Acoustic Mixing" *Propellants Explos. Pyrotech.* 2010, 35, 1-5. Bolton described a solvent based process to create HMX:CL-20 cocrystals, whereby HMX and CL-20 are dissolved in 2-propanol solution and precipitated from the solution. Anderson discussed using solvent drop and resonant acoustic mixing ("RAM"), whereby low frequency, high intensity acoustic energy is applied to the mixing vehicle along with very small amounts of solvent to mechanically mix HMX and CL-20 together until they form a cocrystal.

These solvent based methods, however, often result in impurities or unconverted crystals of the coformer(s) in the final product. Furthermore, these methods of making cocrystals are also relatively difficult to scale.

Nano-sized (less than 1 μm) cocrystals are possibly less sensitive than their counterparts with larger particle size. There have been reports that improved performance characteristics are associated with reducing the size of crystals. For example, the detonation failure diameter, also referred to as the critical diameter, is known to shrink with decreasing crystal size. In addition, HEs with a rounded morphology in plastic bonded explosives were found to produce less sensitive materials. Therefore, a need exists for a safe and simple manufacturing process to synthesize nano-sized cocrystals of energetic materials having improved sensitivity and reactivity.

Use of bead milling was previously discussed by Sowa et al in EP2751085A1 and Chiodo et al in WO 2013143927A1 to prepare cocrystals of fungicide and herbicides respectively. The bead mill has been shown to be an effective method of creating small particle size explosive materials safely using aqueous suspension (see P. Redner et al. "Production and Characterization of Nano-RDX" DTIC report, 2006). These methods, however, fail to disclose bead milling of at least two different explosives precursors having different solubilities in a liquid medium to prepare cocyrstals under a single-step process.

SUMMARY OF THE INVENTION

It is an object of the invention provide a single-step method to prepare nanoscale cocrystalline energetic material by preparing a coformer solution comprising of at least two different energetic coformers wherein a first energetic coformer is dissolved in a liquid medium and a second energetic coformer is suspended in said liquid medium and bead milling the coformer solution to obtain energetic cocrystals wherein said energetic cocrystals have an average particle size of less than 1 μm.

In one aspect of the invention a coformer solution is prepared by mixing a the first energetic coformer, CL-20, which is dissolved in ethyl acetate and second energetic coformer, HMX, which is suspended in the ethyl acetate. The co-formers are mixed at a 2:1 molar ratio respectively.

In another object of the invention at least one excipient is added to the coformer solution such excipient being selected from the group consisting of a surfactant, binder, an anti-foaming agent or plasticizer.

BRIEF DESCRIPTION OF THE DRAWINGS

Further features and advantages of the present invention may be understood from the drawings.

DETAILED DESCRIPTION

Figure 1:
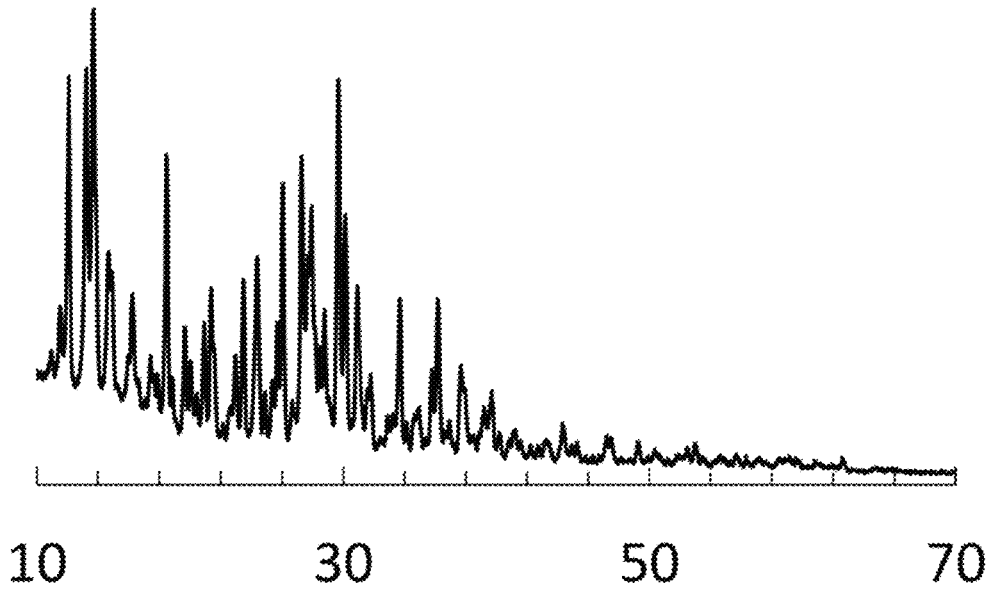
FIG. 1 XRD Scan of HMX:CL-20 Cocrystal Prepared by Bead Milling in Ethyl Acetate.

The present invention relates to a method for producing nano-sized energetic cocrystals directly from precursor coformers of the cocrystal by mechanical activation. In one embodiment of the present invention, the coformer solution may be comprised of both coformers that are insoluble in the same liquid medium such as water. In another embodiment the conformer solution may be comprised of both coformers that are dissolved in the same liquid medium (e.g. solvent). In a preferred embodiment, preparation of the nano-sized energetic cocrystals starts with mixing a coformer solution consisting of at least two high explosive (HE) coformers, wherein at least one being dissolved in a coformer liquid medium and a second coformer being suspended (i.e not dissolved) in the liquid medium.

In the preferred embodiment wherein one co-former is dissolved and a second coformer is suspended, the liquid medium used for the coformer solution may be a solvent or a mixture of solvents such as acetylene, ethanol, acetone, hexane, aromatics, benzenes, ethers, glycols, toluene, xylene, propanol, pyridine, pentane, octane, carbon tetrachloride, butanol, butanone, acetonitrile, acetic acid, chloroform, alcohols, diglyme, dimethyl fluoride, methanol, methylene chloride, heptane, acetates, amines, dioxane, glycerine, glycols.

Excipients (i.e. additives) that function as a binder, plasticizer, surfactant, and anti-foaming agent may also be added to the coformer solution to modify solubility of the ingredients or change the processing parameters of the solution such as viscosity. It is contemplated that a single excipient may have multiple functions. Acceptable binders include: polyisobutylene, chlorowax, flourowax, cellulose acetate butyrate, and polyvinyl acetate. Possible surfactants include: polyoxypropylene glycol alkyl ethers, glucoside alkyl ethers, dodecyldimethylamine oxide, docusates and dimethyldioctadecylammonium chloride. Possible antifoaming agents include oils, fatty waxes, ester waxes, alkyl polyacrylates and paraffin waxes. Possible plasticizers include dioctyal adipate, BIS 2,2-Dinitropropyl acetate, BIS 2,2-Dinitropropyl formal, adipates, sebacates, maleates, and trimellitates.

The coformer solution is loaded into a bead mill and milled for a duration required to completely convert the coformers to the cocrystal (small impurities of the original coformers will, at some level, be impossible to totally eliminate). Once all material has converted to cocrystals, additional milling may be performed to further reduce crystal size. The method provided herein integrates the mechanical conversion of cocrystal with crystal size reduction into a single-step process.

The method described in the present invention is suitable for producing a variety of nano-sized energetic cocrystals, including but not limited to known or unknown cocrystals of RDX, HMX, CL-20, diacetone diperoxide, TNT, tribromotrinitrobenzene, TATB, DNAN, NTO, NQ, DNMT, and others.

The relative amounts of the various ingredients in the mixture should be chosen to reflect the desired composition of the final product. The coformers should be loaded in the correct stochiometric ratio for forming the specific cocrystal. The loading of the solids, including the coformers, can vary between 0.01-50 wt. % of the suspension. The preferred loading of the solids is about 5% to about 30 wt. %. The selection of the liquid medium used in the present invention is flexible, and is based on the solubility of the ingredients to be processed as well as parameters such as viscosity.

The resultant coformer solution is then placed into a bead mill and milled for the required period of time, which will vary based on the targeted type of cocrystals. The time, speed of milling, and bead size are among factors that will directly affect the conversion from the coformers to the energetic cocrystals and the final particle size, which can be as small as 50 nm. Particle size of less than 1 μm is preferred and less than 500 nm is more preferred.

A number of bead mills are commercially available which allow one to create these types of nano-sized energetic cocrystals. The preferred bead mill is Netzsche Bead Mill (Microseries) with yttria-stabilized zirconia beads. Selection of a proper surfactant can achieve quick formation of cocrystals and the desired reduction of particle size. In some cases, the binder can also act as a suitable surfactant. For laboratory work, the fastest milling speed is desirable because it renders the material quickest, however, for industrial applications energy costs will need to be taken into account. Generally, milling time can control particle size fairly effectively. In some cases, an anti-foaming agent may be required. After milling for a required period of time, nano-sized energetic cocrystals can be obtained by removing them from the suspension using a variety of existing processing techniques including spray drying, freeze drying or filtration.

To aid in the understanding of the subject inventive method, the following example is provided as an illustration and should not be construed as a limitation on the claims.

Example 1

Figure 2:
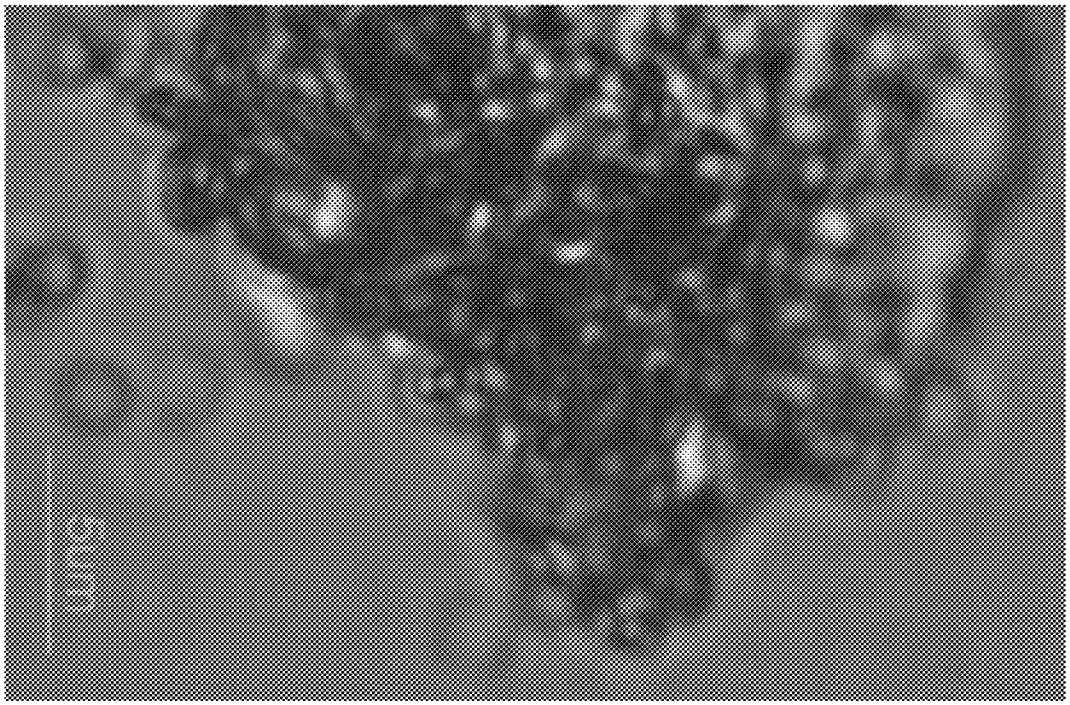
FIG. 2 Optical Image of HMX:CL-20 Cocrystal Prepared by Bead Milling.

Nano-sized energetic cocrystals of CL-20:HMX with a molar ratio of two to one was prepared by bead milling. The process began by mixing 10 g of fluid energy milled (FEM) HMX, 29 g of CL-20, 3 g of polyvinyl acetate (to act as a surfactant/binder), and 400 g of ethyl acetate (coformer liquid medium). The solution was milled using a Netzsche Bead Mill (Microseries) with 300 μm sized beads. The mill was set to a speed of 6800 rpm and the solution was milled for 60 minutes. The formation of cocrystals of CL-20:HMX was confirmed using X-ray diffraction, see FIG. 1. The size of the energetic cocrystal was observed to be less than 500 nm using optical microscopy, see FIG. 2.

Example 2

Nano-sized energetic cocrystals of CL-20/TNT with a molar ratio of 1:1 were prepared by bead milling. The process began by mixing commercially obtained 10.27 g of TNT, 19.73 g of FEM CL-20, 3 g of polyvinyl alcohol (to act as a surfactant/binder), 5 g of isobutanol (to act as antifoaming agent), and 400 g of deionized water. The slurry was milled using a Netzsche Bead Mill (Microseries) with 300

μm size yttria-stabilized zirconia beads. The mill was set to a speed of 6800 rpm and the solution was milled for 60 minutes. The cocrystal structure was confirmed by powder XRD analysis. The crystal size appeared in the nano-scale regime by scanning electron microscopy (SEM).

Example 3

Nano-sized energetic cocrystals of CL-20/HMX with a molar ratio of 2:1 was prepared by bead milling. The process began by mixing 7.5 g of commercially available fluid energy milled (FEM) HMX, 22.2 g of FEM CL-20, 3 g of polyvinyl alcohol (to act as a surfactant/binder), 10 g of isobutanol (to act as antifoaming agent), and 400 g of de-ionized water. Both coformers have a mean particle size of about 1 to 2 μm. The solution was milled using a Netzsche Bead Mill (Microseries) with 300 μm size yttria-stabilized zirconia beads. The mill was set to a speed of 6800 rpm and the solution was milled for 60 minutes.

The formation of cocrystals of CL-20/HMX was confirmed using X-ray diffraction and scanning electron microscopy (SEM) analysis of specimens at various milling times. After 6 minutes of milling, the HMX and CL-20 coformers are in separate crystal phases. After 30 minutes of milling, the coformers are still in separate crystal phases but are beginning to form cocrystals. After 60 minutes of milling, the HMX and CL-20 coformers have completely converted to cocrystals. The size of the energetic cocrystals were observed to be rounded in shape and less than 200 nm using scanning electron microscopy.

While embodiments have been set forth as illustrated and described above, it is recognized that numerous variations may be made with respect to relative weight percentages of various constituents in the composition. Therefore, while the invention has been disclosed in various forms only, it will be obvious to those skilled in the art that additions, deletions and modifications can be made without departing from the spirit and scope of this invention, and no undue limits should be imposed, except as to those set forth in the following claims.

What is claimed is:

1. A process for preparing nanoscale cocrystalline energetic material comprising:

(a) preparing a coformer solution comprising at least two different energetic coformers in stoichiometric ratio, wherein a first energetic coformer is dissolved in a liquid medium and second energetic coformer is suspended in said liquid medium;

(b) adding at least one excipient to said coformer solution; and (c) bead milling the coformer solution to obtain energetic cocrystals wherein said energetic cocrystals have an average particle size of less than 1 μm.

2. The process of claim 1, wherein the total weight of the solids in the conformer solution is between about 0.01% to about 50% by weight of the solution.

3. The process of claim 1, wherein the liquid medium is a liquid selected from the group consisting of acetylene, ethanol, acetone, hexane, aromatics, benzenes, ethers, glycols, toluene, xylene, propanol, pyridine, pentane, octane, carbon tetrachloride, butanol, butanone, acetonitrile, acetic acid, chloroform, alcohols, diglyme, dimethyl fluoride, methanol, methylene chloride, heptane, acetates, amines, dioxane, glycerine, glycols.

4. The process of claim 1, wherein the liquid medium is ethyl acetate.

5. The process of claim 1 wherein the first energetic coformer is at least one crystalline high explosives selected from the group comprising RDX, HMX, CL-20, diacetone diperoxide, TNT, tribromotrinitrobenzene, TATB, DNAN, NTO, NQ, DNMT.

6. The process of claim 1, wherein the second energetic coformer is at least one crystalline high explosives selected from the group comprising RDX, HMX, CL-20, diacetone diperoxide, TNT, tribromotrinitrobenzene, TATB, DNAN, NTO, NQ, DNMT, and wherein the at least one second energetic coformer is not the same as the first energetic coformer.

7. The process of claim 1, wherein the first and second energetic coformers are CL-20 and HMX.

8. The process of claim 7, wherein the CL-20 and HMX are mixed at a ratio of 2:1 molar ratio.

9. The process of claim 1, wherein the mean particle size of the cocrystals is less than microns.

10. The process of claim 1, wherein the mean particle size of the cocrystals are less than 500 nm.

11. The process of claim 1, wherein the excipient is a surfactant, a binder, an antifoaming agent, or plasticizer.

12. The process of claim 11, wherein the binder is selected from the group consisting of polyisobutylene, chlorowax, flourowax, cellulose acetate butyrate, and polyvinyl acetate.

13. The process of claim 11, wherein the surfactant is selected from the group consisting of polyoxypropylene glycol alkyl ethers, glucoside alkyl ethers, dodecyldimethylamine oxide, docusates and dimethyldioctadecylammonium chloride.

14. The process of claim 11, wherein the antifoaming agents is selected from the group consisting of oils, fatty waxes, ester waxes, alkyl polyacrylates and paraffin waxes.

15. The process of claim 11, wherein the plasticizer is selected from the group consisting of dioctyal adipate, BIS 2,2-Dinitropropyl acetate, BIS 2,2-Dinitropropyl formal, adipates, sebacates, maleates, and trimellitates.

16. A process for preparing nanoscale cocrystalline energetic material comprising:

(a) preparing a coformer solution comprising CL-20 dissolved in a ethyl acetate and HMX suspended in ethyl acetate wherein the molar ratio of the CL-20 and HMX is 2:1, (b) adding a binder or surfactant to the coformer solution; and (c) bead milling the coformer solution to obtain cocrystals of Cl-20:HMX wherein said energetic cocrystals have an average particle size of less than 1 μm.

* * * * *